US005361428A

United States Patent [19]

Nanowsky et al.

[11] Patent Number: 5,361,428

[45] Date of Patent: Nov. 8, 1994

[54] SPLASH GUARD FOR USE WITH TRANSFER BENCH

[76] Inventors: John P. Nanowsky, 19727 Pioneer Ct., Humble, Tex. 77346; John H. Kelley, 5751 Sheridan Rd., Youngstown, Ohio 44514

[21] Appl. No.: 138,647

[22] Filed: Oct. 7, 1993

[51] Int. Cl.[5] ..... A47K 3/12; A47K 3/22

[52] U.S. Cl. ..... 4/558; 4/579; 4/604; 4/609

[58] Field of Search ..... 4/546, 558, 559, 573.1, 4/576.1, 577.1, 578.1, 579, 597, 604, 605, 608, 609, 658

[56] References Cited

U.S. PATENT DOCUMENTS

| | | | |
|---|---|---|---|
| 2,725,576 | 12/1955 | Schwersinske | 4/609 |
| 3,855,646 | 12/1974 | Glickman | 4/578.1 |
| 3,895,399 | 7/1975 | Giarrante | 4/558 |
| 4,025,970 | 5/1977 | Robust | 4/559 |
| 4,100,628 | 7/1978 | Franzl | 4/579 |
| 4,168,549 | 9/1979 | Davies | 4/578.1 |
| 4,253,203 | 3/1981 | Thomas | 4/559 |
| 4,391,006 | 7/1983 | Smith | 4/559 |
| 4,472,844 | 3/1984 | Mace | 4/579 |
| 4,722,103 | 2/1988 | Kliebert | 4/658 |
| 4,944,050 | 7/1990 | Shames et al. | 4/609 |
| 4,969,220 | 11/1990 | Raigneau | 4/658 X |

FOREIGN PATENT DOCUMENTS

| | | | |
|---|---|---|---|
| 0257166 | 8/1926 | United Kingdom | 4/658 |
| 2247618 | 3/1992 | United Kingdom | 4/559 |

*Primary Examiner*—Robert M. Fetsuga
*Attorney, Agent, or Firm*—David A. Burge

[57] ABSTRACT

A splash guard for installation about a pair of substantially horizontally extending rails of a transfer bench for cooperating with a shower curtain to prevent water from splashing out of a shower stall or bath tub while the transfer bench is positioned to extend into and out of the stall or tub for supporting an invalid or disabled person. The splash guard includes at least one substantially flat member that is slotted to define one or more rail-receiving passages that permit the splash guard to be installed on and removed from the horizontally extending rails of the transfer bench. In preferred practice, the splash guard is defined by at least two substantially flat members that, when installed on the rails of a transfer bench, extend substantially vertically, side-by-side, with most of the open-slot area of one of the flat members being closed by non-slotted portions of one or more of the other flat members to prevent water from being splashed through the rail-receiving passages. Additional embodiments are disclosed.

23 Claims, 7 Drawing Sheets

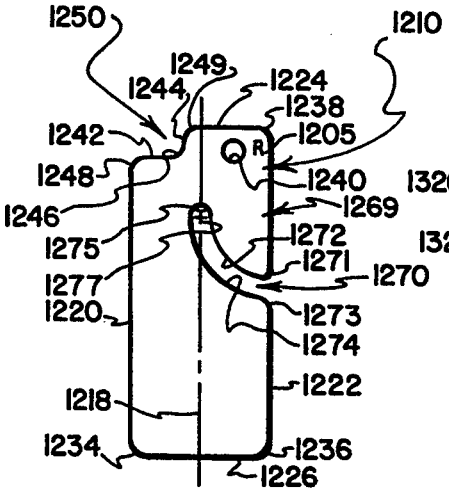
FIG. 13
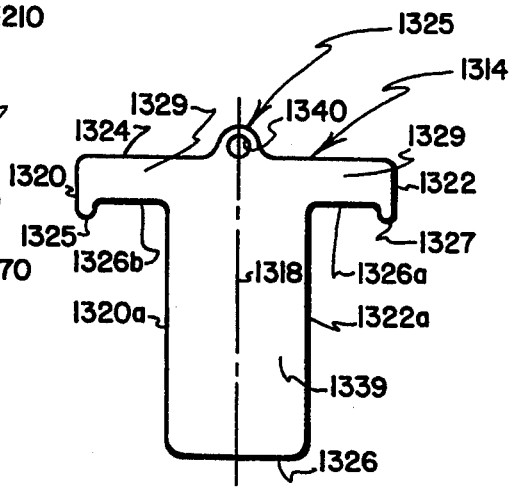
FIG. 14
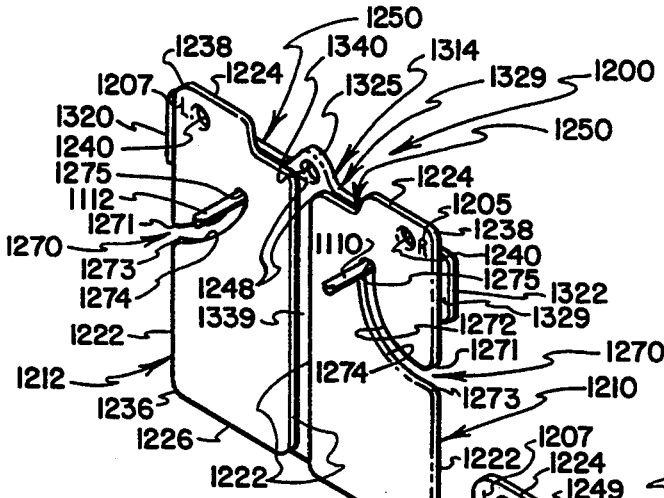
FIG. 15
FIG. 16

SPLASH GUARD FOR USE WITH TRANSFER BENCH

BACKGROUND OF THE INVENTION

1. Field of the Invention

The present invention relates to a splash guard for installation about a pair of substantially horizontally extending rails of a transfer bench for cooperating with a shower curtain to prevent water from splashing out of a shower stall or bath tub while the transfer bench is positioned to extend into and out of the stall or tub for supporting an invalid or disabled person. More particularly, the present invention relates to a splash guard that includes at least one substantially flat member that is slotted to define one or more rail-receiving passages that permit the splash guard to be installed on and removed from the horizontally extending rails of a transfer bench. In preferred practice, the present invention relates to a splash guard that is defined by at least a pair of slotted members that can be installed on the rails of a transfer bench to extend substantially vertically, side-by-side, with most of the open-slot area of one of the members being closed by non-slotted portions of another of the slotted members.

2. Prior Art

The need to provide special support for an invalid or disabled person while bathing or being bathed in a shower stall or bath tub has been met by the provision of a special support appliance that is commonly referred to as a "transfer bench." While transfer benches of a variety of types have been proposed, most have a supporting frame that includes a pair of spaced, substantially horizontal "rails" that extend from outside a shower stall or bath tub to inside the stall or tub, with the frame also including components such as legs for supporting the rails so that the rails can, in turn, underlie and support a substantially horizontally extending seat. The seat serves to support an invalid or disabled person while moving or being moved into and out of a shower stall or bath tub, and to support the invalid or disabled person while bathing or being bathed in the stall or tub.

Usually the horizontal seat-supporting rails of a transfer bench are formed from lengths of tubular material that are positioned about ten to seventeen inches (about 25.4 to about 43.2 cm) apart. Support formations such as legs typically are connected to at least opposite end regions of the horizontal rails and depend from the rails for engaging portions of 1) a floor surface located outside a shower stall or bath tub, 2) an upstanding wall of the shower stall or bath tub, and/or 3) bottom surface portions of a shower stall or bath tub.

Some transfer benches utilize seats that are movable along the horizontal rails to assist an invalid or disabled person in moving into and out of a shower stall or bath tub. When a movable seat of a transfer bench is positioned to support a person at a location inside a shower stall or bath tub, a shower curtain can be draped over the rails at a location where the rails pass from inside to outside the stall or tub. Typical transfer benches of this type are described and illustrated in U.S. Pat. No. 4,253,203 issued Mar. 3, 1981 to Morton I. Thomas, and in U.S. Pat. No. 4,168,549 issued Sep. 25, 1979 to John H. Davies, the disclosures of which are incorporated herein by reference.

Other transfer benches utilize inner and outer seat structures that are rigidly attached to the horizontal rails, with the outer seat structure being spaced about an inch or so from the inner seat structure. To make use of a transfer bench of this type, an invalid or disabled person is seated upon the outer seat structure and slides or is slided therefrom onto the inner seat structure in order to position the person within a shower stall or bath tub—a process that is reversed in order for the person to exit. The space that is provided between the inner and outer seat structures exposes the horizontal rails at a location where the rails pass from inside to outside a shower stall or bath tub, and permits a shower curtain to be draped over the rails at this location. A typical transfer bench of this type is described and illustrated in U.S. Pat. No. 4,391,006 issued Jul. 5, 1983 to Alfred A. Smith, the disclosure of which is incorporated herein by reference.

When a shower curtain is "draped over the rails" of a transfer bench of either of the two types that are described above, an "open space" that is not closed by the shower curtain is defined beneath and between the rails, through which water from a shower stall or bath tub can splash on its way toward forming an unwanted puddle on the floor outside the stall or tub. While a shower stall usually has a short upstanding wall (defining the bottom of the shower stall's entry opening) that serves to close a portion of the "open space" that is not covered by a rail-draped shower curtain, and while a bath tub has an upstanding side wall that serves to close a portion of the "open space" that is not covered by a rail-draped shower curtain, the amount of "open space" that remains "open" to the unwanted splashing of water therethrough is of sufficient size to permit the passage therethrough of a significant amount of water as an invalid or disabled person bathes or is being bathed while seated on a transfer bench.

In an effort to address the lack of splash protection that is afforded by draping a shower curtain across the horizontal rails of a transfer bench, a proposal that has been tried is to vertically slit bottom portions of the shower curtain so that each of the rails can be received within the upper end region of a separate slit, and so that a bib-shaped portion of the shower curtain (defined as the portion of the shower curtain that is located between the two slits) can be threaded between the rails for closing much of the "open space" that otherwise would remain "open" if the shower curtain were simply draped across the rails. However, slitting a shower curtain in the manner just described causes the curtain to lose its effectiveness when it is to be used while no transfer bench is present in a shower stall or bath tub; and, the slits often tend to elongate in length such that the effective service life of the shower curtain often terminates prematurely. Moreover, when a slit curtain is used with a transfer bench, the effort that is needed to thread a "bib" of the shower curtain material between the horizontal rails of the transfer bench is time consuming, causes undue wear and tear on the curtain, and often is difficult for an invalid or disabled person to carry out sufficiently effectively to ensure that the threaded "bib" will perform its intended splash-preventing function.

SUMMARY OF THE INVENTION

The present invention addresses the foregoing and other drawbacks and shortcomings of the prior art by providing a splash guard for installation about a pair of substantially horizontally extending rails of a transfer bench for cooperating with a shower curtain to prevent water from splashing out of a shower stall or bath tub while the transfer bench is positioned to extend into and out of the stall or tub for supporting an invalid or disabled person.

A feature of the present invention resides in its use of at least one substantially flat member that defines one or more rail-receiving formations that each is configured to receive a separate one of the two spaced, horizontal rails of a transfer bench. The rail-receiving formations are configured to permit the substantially flat members to engage and to be "hung" from the horizontal rails of a transfer bench.

A further feature of the present invention resides in its utilization of flat members that each are configured so that, when it is "hung" from one or both of the horizontal rails of a transfer bench, its center of gravity is located a sufficient distance beneath where it is supportingly engaged by one or both of the rails so that the force of gravity acting thereon will tend to cause the rail-hung member to assume and maintain orientation in a plane that extends substantially vertically. Because each of the flat, rail-hung members will tend to extend substantially vertically in planes that extend substantially at right angles to the axes of the rail or rails from which they are hung, a plurality of the flat members can be positioned to extend closely side-by-side so that the resulting set of rail-hung members effectively cooperate to define a splash guard of desired shape that extends in a desired manner about the rails for cooperating with a hanging shower curtain that is draped over the rails of a transfer bench to close what would otherwise amount to "open space" (typically located beneath and between the rails) through which space water otherwise would tend to splash from a shower stall or bath tub.

A feature of the preferred practice of the present invention resides in the use of elongate, typically slot-shaped, rail receiving formations, major "open-slot areas" of which are effectively closed once the splash guard is installed on the rails of a transfer bench. In preferred practice, the slot-shaped rail-receiving formations extend from an edge of an associated flat member toward a central region thereof, with opposite sides of each such slot forming an elongate passage through which portions of a rail can be moved as the associated flat member is installed onto and removed from one or more of the horizontal rails of a transfer bench. In one embodiment, resiliently bendable material having a "memory" is used to define opposite side portions of the elongate passages that normally tend to extend substantially contiguously within a common plane so as to "normally close" "open-slot area" that can be "opened" temporarily by bending the resiliently bendable material that is located along opposite sides of a rail-receiving passage to permit movement therebetween of portions of a rail of a transfer bench. In a more preferred embodiment, opposite sides of the elongate rail-receiving passages are spaced apart by sufficient distance to permit portions of a transfer bench rail to pass freely therebetween; and, as installation of the splash guard is completed, a majority of the "open-slot area" of one of the flat members is effectively closed by non-slotted portions of another of the flat members—which closure takes place as the flat members are brought into closely overlying side-by-side relationship after being slot-hung from the rails of a transfer bench.

In most preferred practice, several of the features described above are combined to provide a splash guard that utilizes a pair of substantially flat members that each are slotted to define at least one elongate rail-receiving passage, that each are configured so that it can be slot-hung from one or both of the rails of a transfer bench while presenting a center of gravity that is located sufficiently beneath the loci of supporting engagement with the rails to ensure that the flat members retain vertical orientations, and that each defines non-slotted portions that are configured to overlie so as to effectively close "open-slot area" of the other of the flat members when the flat members are brought into closely overlying side-by-side relationship after being slot-hung from the rails of a transfer bench.

While three or more slotted members having a variety of configurations can be used to comprise the set of substantially flat members that forms a splash guard, in most preferred practice only two substantially flat, members are used to form a splash guard. Moreover, in preferred practice, these two members are of substantially identical, generally rectangular configuration, with each defining a pair of spaced slots for receiving the spaced rails of a transfer bench. While the identically configured members can be installed on the rails of a transfer bench such that correspondingly configured portions of the two members extend congruently, when the members are installed for use as a splash guard, one of the identically configured members is reversed relative to the other so that the members extend non-congruently, with most of the open slot area of one member being closed by non-slotted portions of the other member.

In one preferred embodiment, the two slots that are formed in each of the two identically configured, generally rectangular members are linear and extend in parallel relationship at a uniform spacing that corresponds to the spacing of a particular set of rails that the slotted members are configured to fit. The parallel-extending slots are inclined relative to the vertical so that, when one of the identically configured slotted members is reversed relative to the other so that the slotted members hang non-congruently from the rails, the "open-slot area" of one member is, in large measure, closed by non-slotted portions of the other member.

In an even more preferred embodiment, one of the two slots that is formed in each of the generally rectangular shaped slotted members is substantially linear (i.e., not curvilinear) and is oriented so as to extend substantially horizontally when the associated flat member is rail-hung during installation, with the slot opening through a vertically extending edge of the periphery of the associated member. The other of the rail-receiving slots is curvilinear and opens downwardly through a bottom edge of the periphery of the associated member.

The provision of such a combination of one linear and one curvilinear slot in each of the generally rectangular shaped slotted members offers a number of advantages. One advantage is a capability that is provided to accommodate transfer benches that have a relatively wide range of rail spacings, with such spacings typically falling within the range of about ten inches on center to about seventeen inches on center—with the linear slot being of sufficient length to accommodate rail spacings within this typical range.

A further advantage that obtains with the use of one substantially horizontally extending linear slot and one substantially vertically extending curvilinear slot is that, when identically configured members carrying such slots are installed on a pair of transfer bench rails with each of the rails of the bench being received in a separate one of the curvilinear slots, the "right angle orientation" of such slot portions as intersect at the locations where the rails are received in the slots minimizes the amount of "open-slot area" that remains "open." Stated in another way, such an arrangement of slots helps to ensure that most of the "open-slot area" of one slotted member is closed by non-slotted portions of the adjacent slotted member so that a bare minimum of "open-slot area" remains "open" to permit water to splash therethrough.

In preferred practice, the substantially flat member or members that form a splash guard have all of their exposed edges smoothly rounded, including such edge surfaces as define perimeter portions as well as rail-receiving formations of the member or members.

Still another feature of preferred practice resides in configuring the slotted members so that each is provided with a finger-grip formation that can be grasped with ease to facilitate both the installation of slotted members on the rails of a transfer bench, and the removal of slotted members from the rails of a transfer bench. In preferred practice, the finger-grip formations take the form of holes that extend through the members, with the holes being of sufficient size to permit one to insert an index finger through such holes to assist in grasping the slotted members, and with the configurations of the members being such that, when the members are installed on the rails of a transfer bench, none of the flat material of one slotted member obstructs access to the finger-grip formations of the other installed slotted members.

BRIEF DESCRIPTION OF THE DRAWINGS

These and other features, and a fuller understanding of the present invention may be had by referring to the following description and claims, taken in conjunction with the accompanying drawings, wherein:

FIG. 13 is a side elevational view of one of two identical slotted members that are utilized in the splash guard embodiment of FIG. 11;

FIG. 14 is a side elevational view of a differently configured member that also is utilized in the splash guard embodiment of FIG. 11;

FIG. 15 is a perspective view showing the members of the embodiment of FIG. 11 fully installed on portions of two relatively closely spaced, horizontally extending rails of a transfer bench;

FIG. 16 is a perspective view similar to FIG. 15 but showing the members fully installed on portions of two relatively widely spaced, horizontally extending rails of a transfer bench;

DESCRIPTION OF THE PREFERRED EMBODIMENT

Figure 1:
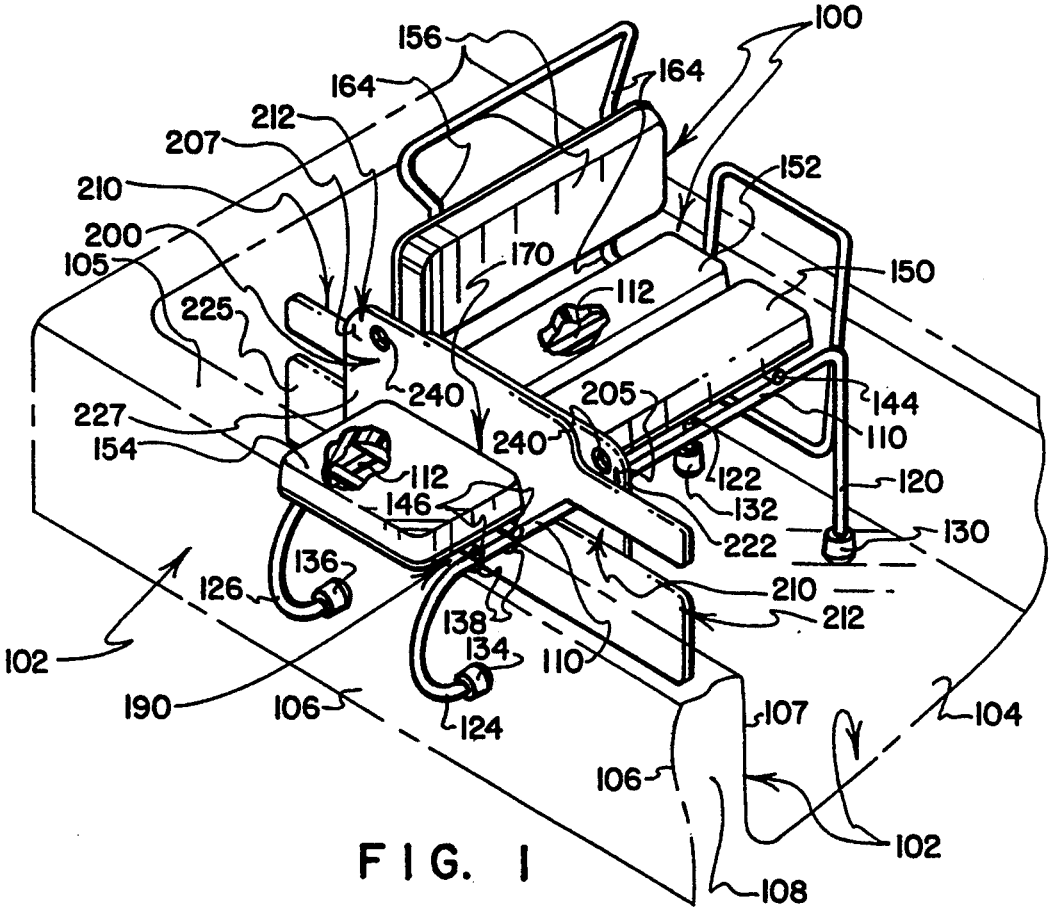
FIG. 1 is a perspective view of one known form of transfer bench positioned to extend into and out of a bath tub, with portions of inner and outer seat members of the transfer bench being broken away to permit portions of one of two horizontally extending rails of the transfer bench to be seen, with an outline of the bath tub being depicted by broken lines, and with a splash guard that embodies the preferred practice of the present invention shown installed on the horizontally extending rails of the transfer bench.
Figure 2:
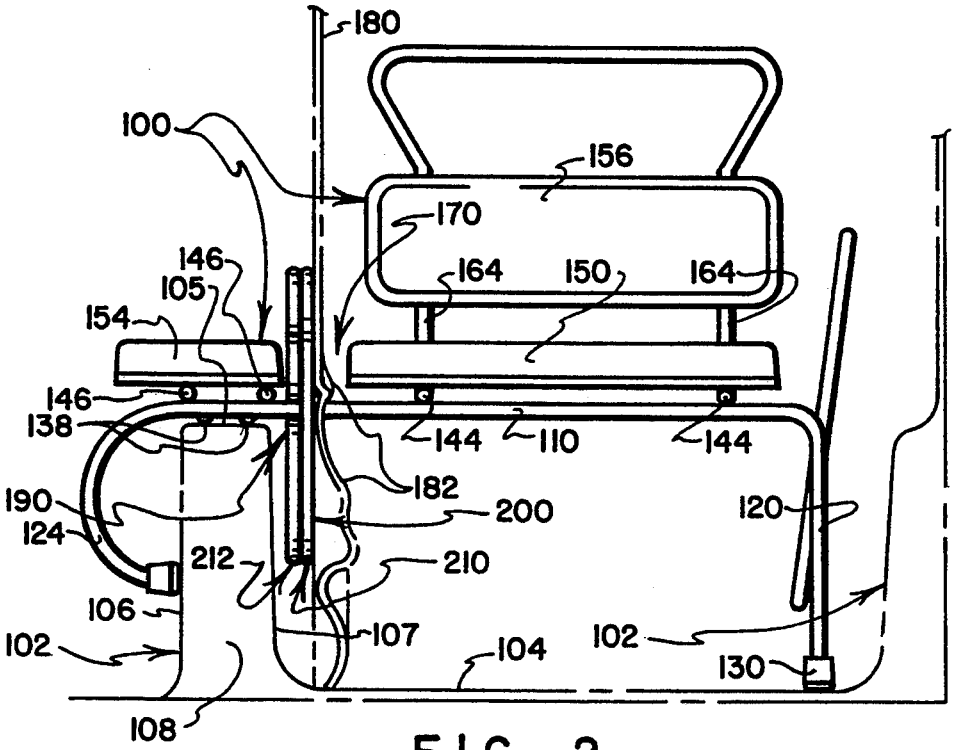
FIG. 2 is a front side elevational view thereof, with an outline of selected portions of the bath tub again being depicted by broken lines, and with selected portions of a shower curtain that is draped over the horizontally extending rails of the transfer bench also being depicted by broken lines.

Referring to FIGS. 1 and 2, a transfer bench 100 of the general type that is depicted and described in the above-referenced U.S. Pat. No. 4,391,006 is shown with a splash guard 200 that embodies the preferred practice of the present invention installed about two substantially horizontally extending rails 110, 112 of the bench 100. Because the transfer bench 100 is of a known, commercially available type, features of which are depicted and fully described in the above-referenced U.S. Pat. No. 4,391,006 (which patent is incorporated herein by reference), only a brief discussion of the character of the transfer bench 100 will be presented in this document.

Inner end regions of the horizontally extending rails 110, 112 are identically turned downwardly to form legs 120, 122, respectively, that carry rubber-cushioned feet 130, 132, respectively, for engaging the upwardly facing bottom wall 104 of a bath tub 102. Outer end regions of the horizontally extending rails 110, 112 are identically reverse-bent to form positioning formations 124, 126, respectively, that carry rubber-cushioned feet 134, 136, respectively, for engaging outer surface portions 106 of an upstanding side wall 108 of the bath tub 102. Resilient feet formations 138 are connected to the rails 110, 112 at locations overlying a top surface 105 that defines the height of the side wall 108 of the bath tub 102.

A plurality of inner crossbars 144 and outer crossbars 146 bridge between and have their opposite end regions rigidly connected to the horizontally extending rails 110, 112. A pair of inner seat members 150, 152, and an outer seat member 154 are mounted atop and are supported by the inner and outer crossbars 144, 146, respectively. As is best seen in FIG. 2, two inner crossbars 144 underlie the inner seat members 150, 152, and connect with uprights 164 for supporting an inner seat back member 156 at a location above and behind the inner seat members 150, 152. Two outer crossbars 146 underlie the outer seat member 154. A space 170 of typically greater than an inch in width is provided between the outer seat member 154 and the inner seat members 150, 152 at a location where the horizontal rails 110, 112 bridge an inner surface 107 of the upstanding side wall 108 of the bath tub 102.

Referring to FIG. 2, bottom portions 182 of a conventional, vertically-hung shower curtain 180 are draped over the horizontal rails 110, 112 at the location of the space 170 that extends between the outer seat member 154 and the inner seat members 150, 152. Because such bottom portions 182 as bridge between the rails 110, 112 are held aloft at a height that is greater than the height of the upstanding side wall 108 of the bath tub 102, an "open space" that is designated generally by the numeral 190 is defined beneath and between the rails 110, 112, through which water easily can splash on its way toward forming an undesirable puddle on a floor surface located outside the bath tub 102.

Figure 7:
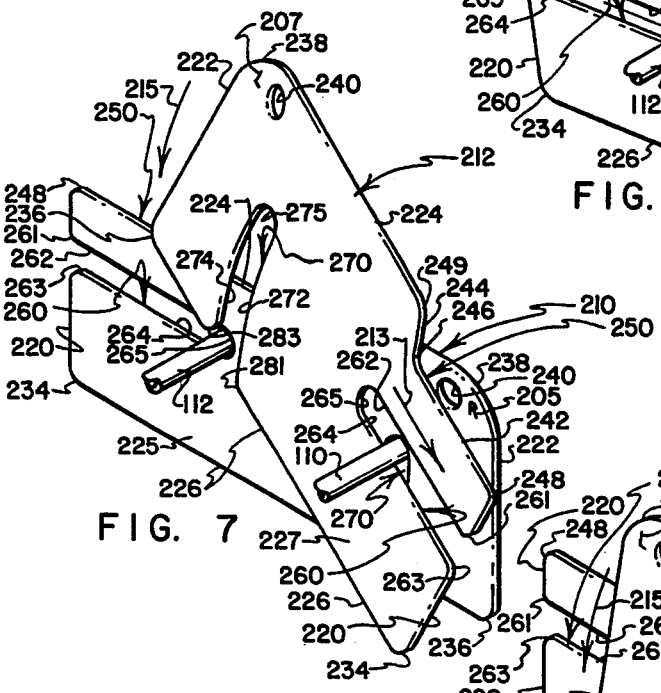
FIG. 7 is a perspective view similar to FIGS. 5 and 6 showing the first slotted member fully installed on the horizontally extending rails, and depicting one stage in a procedure that is utilized to install a second of the slotted members of FIG. 3 on the horizontally extending rails of the transfer bench.
Figure 8:
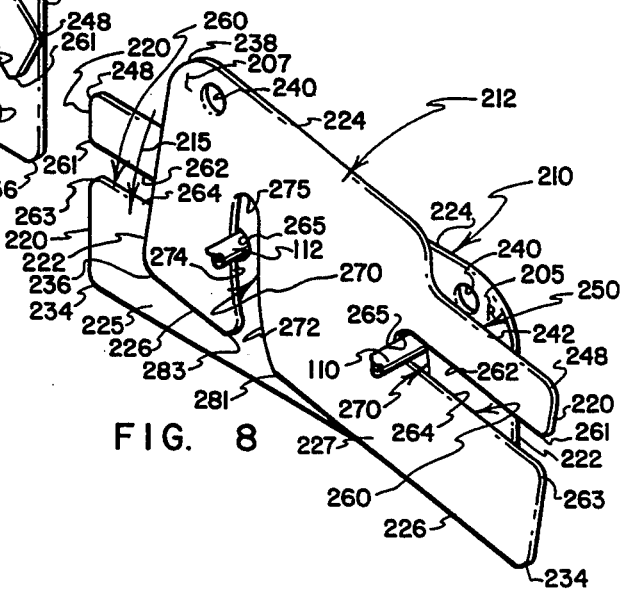
FIG. 8 is a perspective view similar to FIG. 7 but illustrating a more advanced stage in the procedure that is utilized to install the second slotted member on the spaced, horizontally extending rails of the transfer bench.

The splash guard 200 that is shown installed on the horizontal rails 110, 112 of the transfer bench 100 cooperates with the lower portions 182 of the shower curtain 180 to effectively close the open space 190 to prevent the unwanted splashing of water therethrough. Referring to FIGS. 1, 2 and 7, the splash guard 200 is defined by a pair of substantially identically configured, generally rectangular, slotted members 210, 212 that each are substantially flat.

Figure 9:
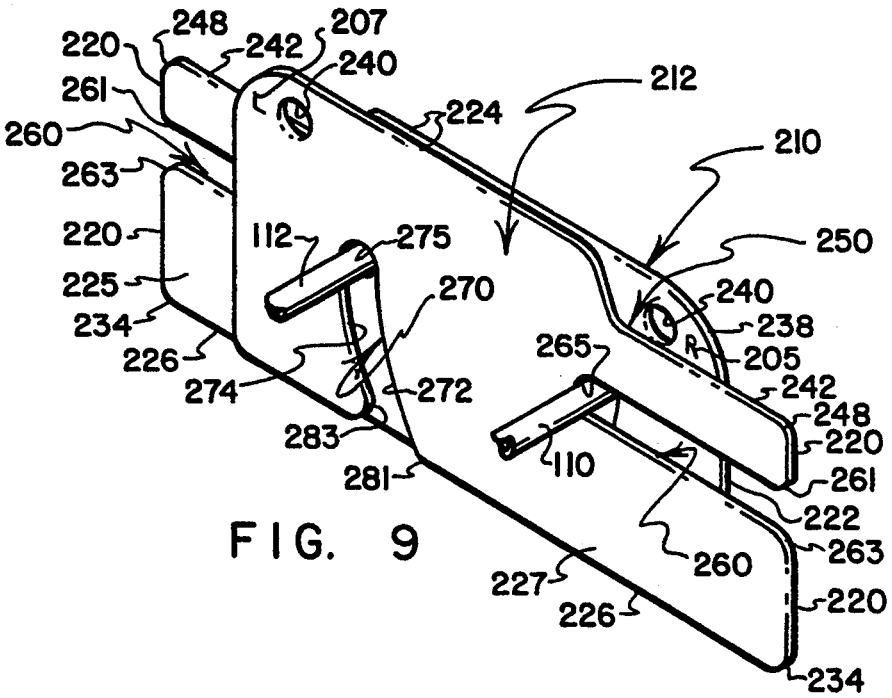
FIG. 9 is a perspective view similar to FIG. 8 but showing both of the slotted members fully installed on portions of two relatively closely spaced, horizontally extending rails of a transfer bench.

When the identical splash guard members 210, 212 are used in "reversed oriented pairs" for being supported by the rails 110, 112 by being "rail hung" thereon, as is depicted in FIGS. 1 and 9, it will be observed that one of the splash guard members (in this case the member 210) is positioned "relatively rearwardly" (in that it is positioned relatively more "inwardly" with respect to the bath tub 102 and occupies a position on the rails 110, 112 that is located relatively near to the seat members 150, 152, 156), while the other splash guard member (in this case the member 212) is positioned "relatively forwardly" (in that it is positioned relatively more "outwardly" with respect to the bath tub 102 and occupies a position on the rails 110, 112 that is located relatively farther away from the seat members 150, 152, 156). Stated in another way, in the arrangement of splash guard members 210, 212 that is depicted in FIGS. 1 and 9, the splash guard member 210 is installed such that it is the "rear" member (i.e., it occupies a relatively "rear" position), and the splash guard member 212 is installed such that it is the "front" member (i.e., it occupies a relatively "front" position).

In actual use, it makes no difference which one of the splash guard members 210, 212 is installed so as to occupy the "front" and "rear" positions; nor does it particularly matter whether lower portions 182 of the shower curtain 180 1) extend forwardly of the "front" one of the two guard members 210, 212, 2) extend rearwardly of the "rear" one of the two guard members 210, 212, or 3) extend between the two guard members 210, 212. The guard members 210, 212 will function to cooperate with the rail-draped shower curtain 180 regardless of whether draped lower portions 182 of the shower curtain extend forwardly of both, rearwardly of both, or between the two members 210, 212. In preferred practice, however, the two members 210, 212 are positioned outside curtain 180 closely side-by-side (with no part of the lower portions 182 of the shower curtain 180 extending between the members 210, 212) so that non-slotted portions of each of the members 210, 212 will extend closely alongside and bridge open-slot areas of the other of the members 210, 212 to effectively close open-slot areas of each of the members 210, 212 to the splashing of water there-through. As a practical matter, however, it has been found that the splash-guard function of the members 210, 212 is not significantly inhibited if lower portions 182 of the draped shower curtain 180 are interposed between the members 210, 212.

Because the splash guard members 210, 212 are of identical configuration, only the splash guard member 210 will be described. In the drawings, the same numerals that are used in the description that follows to designate features of the splash guard member 210 also are used to designate identical features of the identical splash guard member 212.

Figure 3:
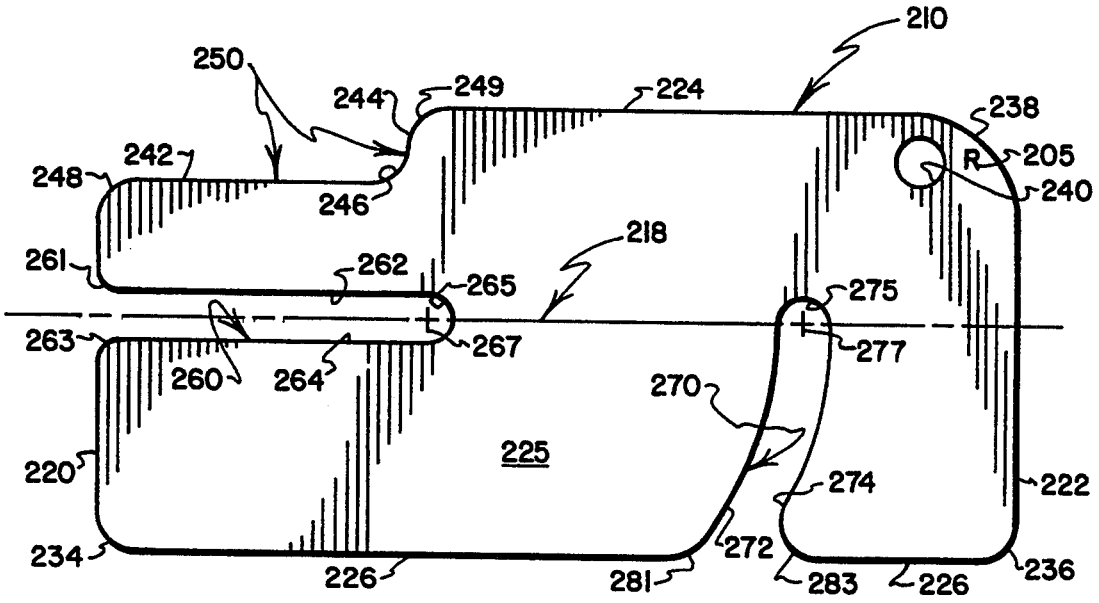
FIG. 3 is a side elevational view of one of two identical, generally rectangular, slotted members that are utilized in carrying out the preferred practice of the present invention.
Figure 4:
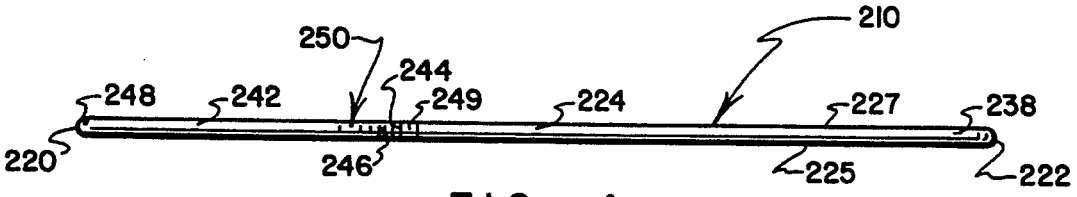
FIG. 4 is a top plan view of the slotted member shown in FIG. 3.

Referring to FIGS. 3 and 4, the splash guard member 210 preferably is formed from a relatively rigid material such as high density polypropylene having a relatively uniform thickness of preferably about 0.08 inch (about 0.20 cm) except along exposed edge portions which preferably are rounded at a radius of curvature that equals about half of the substantially uniform thickness of the splash guard member 210 (i.e., a radius of curvature of about 0.04 inch, or about 0.10 cm)—whereby exposed edges (such as the upstanding edge surfaces 220, 222 and the generally horizontally extending edge surfaces 224, 226) of the splash guard member 210 are smoothly rounded.

As is best seen in FIG. 4, the splash guard member 210 has a front surface that is indicated by the numeral 225, and an opposed, parallel-extending rear surface that is indicated by the numeral 227. While each of the splash guard members 210, 212 has what will be referred to as a "front surface 225" and a "rear surface 227," when the splash guard members 210, 212 are positioned in "reversed oriented pairs," as is depicted in FIGS. 1 and 9, the splash guard member 210 has its front surface 225 facing "frontwardly" and its rear surface 227 facing "rearwardly;" however, the splash guard member 212 has its front surface 225 facing "rearwardly" and its rear surface 227 facing "frontwardly."

The distance that separates the top and bottom edge surfaces 224, 226 of the splash guard member 210 is typically about eleven and a half inches (about 29.2 cm), and will be referred to as the "height" of the splash guard member 210. The distance that separates the left and right edge surfaces 220, 222 is typically about twenty three and a half inches (about 59.7 cm), and will be referred to as the "length" of the splash guard member 210. Because the top and bottom edge surfaces 224, 226 extend at right angles to the left and right edge surfaces 220, 222, the height and length of the splash guard member 210 cooperate to impart a shape to the splash guard member 210 that can be referred to as being "generally rectangular" in character.

An imaginary axis, indicated in FIG. 3 by the numeral 218, extends parallel to the top and bottom edge surfaces 224, 226 at a location that is nearly mid-way between the surfaces 224, 226, but which is slightly closer (by preferably about one-fourth inch—i.e., by about 0.6 cm) to the top edge surface 224 than to the bottom edge surface 226. Rounded "corners" 234, 236 having a radius of curvature of preferably about one inch (about 2.5 cm) are defined at the junctures of the bottom edge surface 226 with the left and right edge surfaces 220, 222, respectively. A rounded "corner" 238 having a radius of curvature of preferably about three inches (about 7.6 cm) is defined at the juncture of the top edge surface 224 with the right edge surface 222.

A finger-grip hole 240 is defined by the member 210 in the vicinity of the rounded "corner" 238, with the hole 240 preferably being of about one and one quarter inch (about 3.2 cm) in diameter. At a "corner" location near the finger-grip hole 240, a letter "R" (indicated by the reference numeral 205) is displayed on a front surface 225 of the splash guard member 210. Immediately behind the location of the letter "R" (reference numeral 205) on the front surface 225, a letter "L" (indicated by the reference numeral 207) is displayed on the rear surface 227 (which is best seen in FIGS. 7–10 wherein the "L" (reference numeral 207) that appears on the frontward-facing rear surface 227 of the splash guard member 212 will be seen to be located near the left-upper corner of the splash guard member 212, adjacent where the finger-grip hole 240 opens through the rear surface 227.

Toward the upper left "corner" of the member 210, an "inset" or "cut-out" 250 is defined by an upwardly facing edge surface 242 and a leftwardly facing edge surface 244 that parallel the top edge surface 224 and the left edge surface 220, respectively. The surfaces 242, 244 are smoothly joined by a curved surface 246 that preferably has a radius of curvature of about one inch (about 2.5 cm). Rounded "corners" 248, 249 that also preferably having a radius of curvature of about one inch (about 2.5 cm) form smooth junctures between the upwardly facing surface 242 and the left edge surface 220, and between the leftwardly facing surface 244 and the top edge surface 224, respectively.

Figure 10:
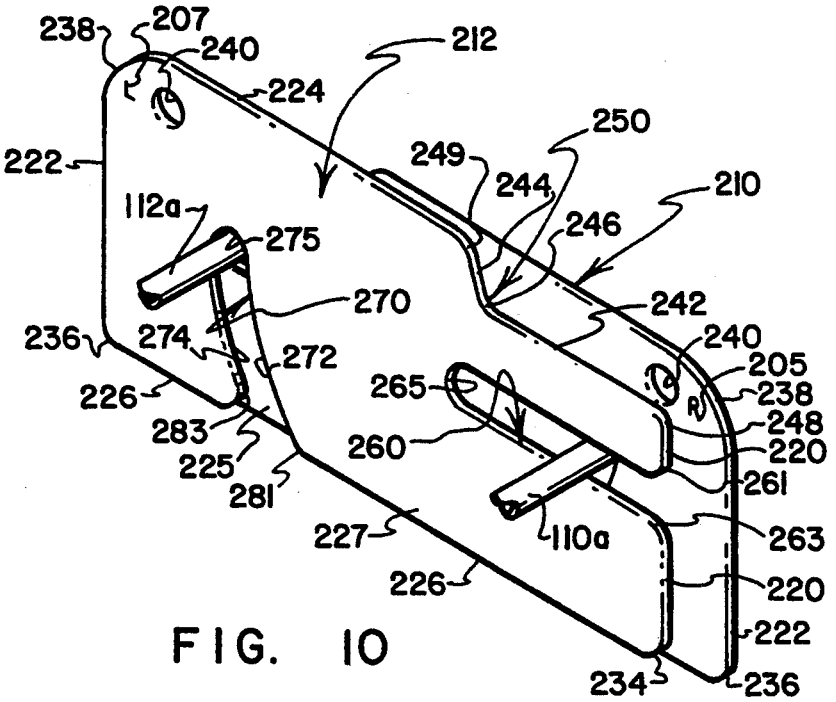
FIG. 10 is a perspective view similar to FIG. 9 but showing the slotted members fully installed on portions of two relatively widely spaced, horizontally extending rails of a transfer bench.

By providing each of the members 210, 212 with an "inset" or "cut-out" area 250, when a pair of the members 210, 212 are installed on the rails 110, 112 in "reversely oriented pairs" (on the relatively narrowly spaced rails 110, 112 as is depicted in FIGS. 1 and 9, and on more widely spaced rails **110*a*, 112*a* that are depicted in FIG. 10), the cut-out areas 250 function to ensure both 1) that ready access can be had to the finger-grip holes 240, and 2) that the letters "R" and "L" (reference numerals 205 and 207) that are imprinted on the surfaces 225, 227 at locations adjacent where the finger-grip holes 240 open through the surfaces 225, 227** will be visible).

The reason why the letters "R" and "L" (reference numerals 205 and 207) are imprinted on the front and rear surfaces 225, 227, respectively, is to provide an easily-understood installation aid. Regardless of whether an end user elects to position the member 210 forwardly or rearwardly with respect to the member 212 when the members 210, 212 are to be installed on the rails 110, 112 (or on the more widely spaced rails **110*a*, 112*a* depicted in FIG. 10), proper "reverse orientation" of the members 210, 212 will be achieved if the user simply remembers to orient the members 210, 212 so that one of the members displays a letter "R" (reference numeral 205) that faces toward the user, and so that the other of the members displays a letter "L" (reference numeral 207) that faces toward the user. If the displayed letters "R" and "L" of a "reversely oriented" pair of the members 210, 212 face toward the user, and if the "R" and "L" are oriented "right side up" rather than "upside down, " the members 210, 212** are properly "reversely oriented" for installation.

Referring to FIG. 3, a U-shaped, substantially linear notch 260 extends along the center axis 218 for a distance of about eight and one half inches (about 21.6 cm, measured from the left edge surface 220). The linear notch 260 is bordered by top and bottom edge surfaces 262, 264 that extend substantially parallel and are separated by a distance of about one and one-fourth inches (about 3.2 cm) Rounded "corners" 261, 263 (that also preferably have radii of curvature of about one-half inch, i.e., about 1.3 cm) are formed where the top and bottom edge surfaces 262, 264 join with the left edge surface 220 as the linear notch 260 opens through the left end of the member 210. A semi-circular arc 265 having a radius of curvature equal to half the width of the linear slot 260 smoothly joins the top and bottom edge surfaces 262, 264. The arc 265 is formed about a center point that is intersected by the center axis 218, as is indicated by the numeral 267.

Also intersected by the center axis 218 is a center point 277 about which another substantially semi-circular arc 275 is formed. The semi-circular arc 275 joins the upper ends of a pair of curved surfaces 272, 274 that define opposite sides of a curvilinear notch 270. The arcs 272, 274 are formed about the center point 267 at radii of curvature of about eight and seven-eights inch (about 22.5 cm), respectively, and about ten and one-eighth inch (about 25.7 cm), whereby the curvilinear notch 270 is given a width of about one and one quarter inch (about 3.2 cm) Rounded "corners" 281, 283 smoothly join lower ends of the arcs 272, 274 with the bottom edge surface 226.

The manner in which a pair of the slotted members 210, 212 preferably are installed on the rails 110, 112 so as to extend non-congruently but side-by-side in closely spaced relationship (as is depicted in FIGS. 1, 2 and 9) is illustrated in the sequence of views that comprise FIGS. 5 through 9.

Figure 5:
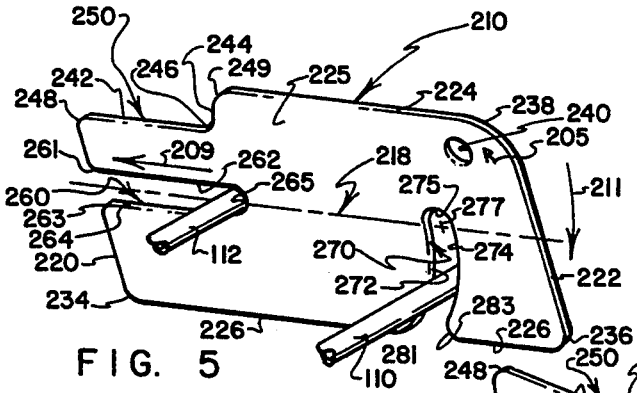
FIG. 5 is a perspective view depicting one stage in a procedure that is utilized to install a first one of the slotted members of FIG. 3 on the spaced, horizontally extending rails of the transfer bench.
Figure 6:
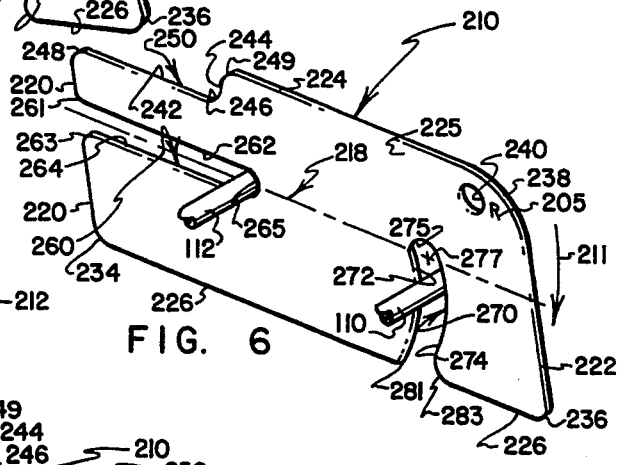
FIG. 6 is a perspective view similar to FIG. 5 but illustrating a more advanced stage in the procedure that is utilized to install the first slotted member on the spaced, horizontally extending rails of the transfer bench.

Referring to FIG. 5, installation of a first of the slotted members 210 on the spaced, horizontally extending rails 110, 112 of the transfer bench 100 is begun by moving the first slotted member 210 relative to the rail 112 (e.g., in a direction extending along the linear slot 260 that is indicated generally by the arrow 209) in a manner that causes the rail 112 to be introduced into and to be moved within and along the linear slot 260 of the first slotted member 210. Installation is continued by moving the first slotted member 210 relative to the rail 110 (e.g., in a direction that extends along the curvilinear slot 270 that is indicated generally by the arrow 211 in FIGS. 5 and 6) to cause the rail 110 to be introduced into, and to be moved within and along the curvilinear slot 270 of the first slotted member 210. Such movement is continued until the semi-circular arc 275 of the curvilinear slot 270 of the first slotted member 210 is seated in engagement with the rail 110 (as is depicted in FIGS. 1, 2 and 7–9).

Referring to FIG. 7, installation of the second of the slotted members 212 on the rails 110, 112 of the transfer bench 100 is begun by moving the second slotted member 212 relative to the rail 110 (e.g., in a direction extending along the linear slot 260 that is indicated generally by the arrow 213 ) in a manner that causes the rail 110 to be introduced into and to be moved within and along the linear slot 260 of the second slotted member 212. Installation is continued by moving the second slotted member 212 relative to the rail 112 (e.g., in a direction that extends along the curvilinear slot 270 that is indicated generally by the arrow 215 in FIGS. 7 and 8) to cause the rail 112 to be introduced into, and to be moved within and along the curvilinear slot 270 of the second slotted member 212. Such movement is continued until the semi-circular arc 275 of the curvilinear slot 270 of the second slotted member 212 is seated in engagement with the rail 112 (as is depicted in FIGS. 1, 2 and 9).

With the two slotted members 210, 212 installed on the rails 110, 112 so as to extend non-congruently, as is depicted in FIG. 9, the "open slot area" (defined by the area of the linear and curvilinear slots 260, 270 that is not occupied by one of the rails 110, 112) is, in large measure, "closed" by non-slotted material of the other of the slotted members 210, 212 so that only a minimum of truly "open" "open slot area" remains available for water to splash through—namely such slot area as is commonly defined by aligned portions of the slots 260, 270 where the slots 260, 270 cross (so as to align) in the immediate vicinities of the rails 110, 112.

While the spacing of the rails 110, 112 that is depicted in FIG. 9 is a relatively narrow spacing of typically about ten inches (about 25.4 cm) on center, a number of commercially available transfer benches have wider rail spacings, with some being as great as about seventeen inches (about 43.2 cm) on center. A wider rail spacing is illustrated in FIG. 10 wherein rails 110*a*, 112*a* are depicted that typically have a spacing of about fourteen inches (about 35.6 cm) on center. As will be observed by comparing the relative positions of the splash guard members 210, 212 as depicted in FIGS. 9 and 10, the presence of the linear, substantially horizontally extending slots 260 in each of the members 210, 212 permits the members 210, 212 to accommodate a relatively wide range of transfer bench rail spacings.

Figure 11:
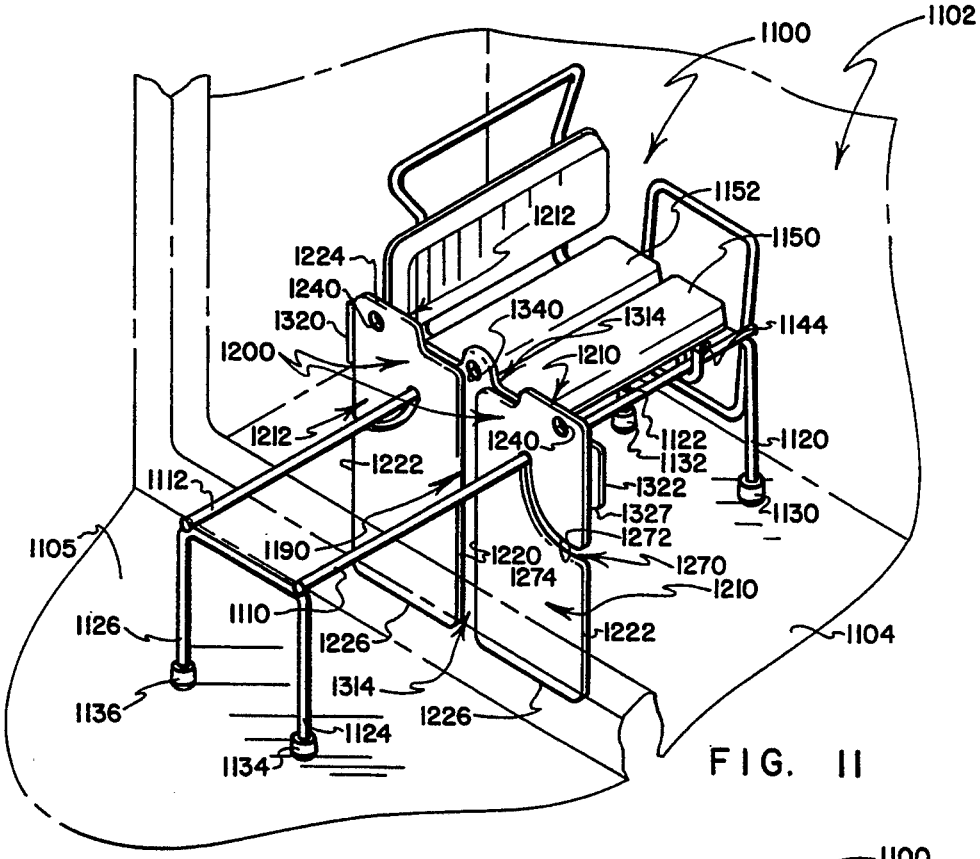
FIG. 11 is a perspective view of an alternate form of transfer bench that is positioned to extend into and out of a shower stall, with an outline of the shower stall being depicted by broken lines, and with a splash guard that embodies an alternate form of the present invention shown installed on the horizontally extending rails of the transfer bench.
Figure 12:
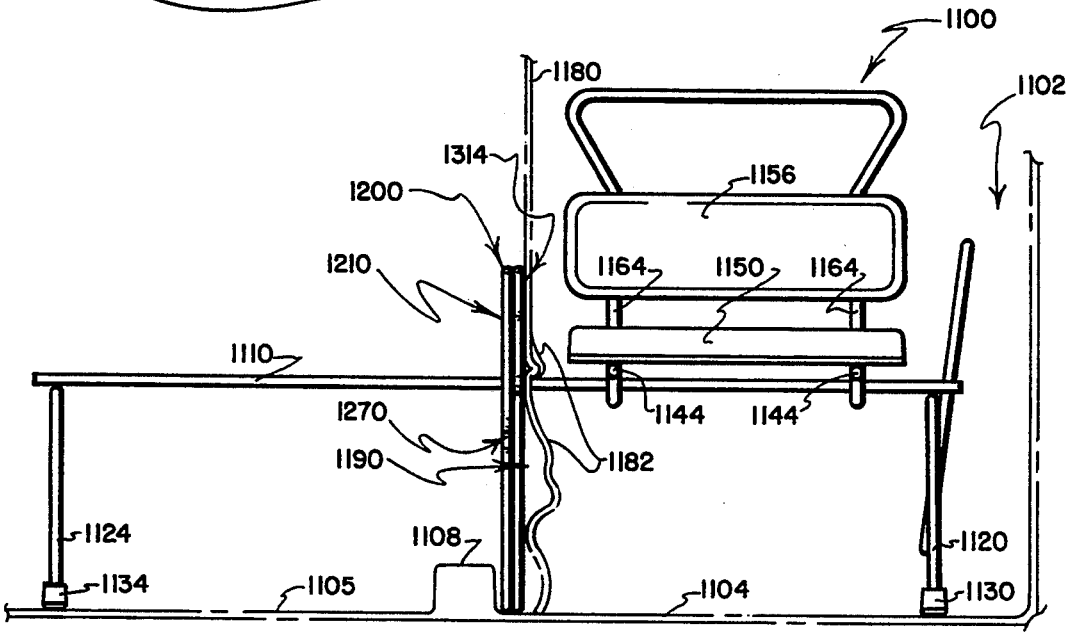
FIG. 12 is a front side elevational view thereof, with bottom portions of a shower curtain that is draped over the horizontally extending rails of the transfer bench also being depicted by broken lines.

Referring to FIGS. 11 and 12, a transfer bench 1100 of the general type that is depicted and described in the above-referenced U.S. Pat. No. 4,253,203 is shown with a splash guard 1200 that embodies an alternate form of preferred practice of the present invention installed about two substantially horizontally extending rails 1110, 1112 of the bench 1100. Because the transfer bench 1100 is of a known, commercially available type, features of which are depicted and fully described in the above-referenced U.S. Pat. No. 4,253,203 (which patent is incorporated herein by reference), only a brief discussion of the character of the transfer bench 1100 will be presented herein.

Inner end regions of the horizontally extending rails 1110, 1112 are supported by upstanding legs 1120, 1122, respectively, that carry rubber-cushioned feet 1130, 1132, respectively, for engaging the upwardly facing bottom wall 1104 of a shower stall 1102. Outer end regions of the horizontally extending rails 1110, 1112 are supported by upstanding legs 1124, 1126, respectively, that carry rubber-cushioned feet 1134, 1136, respectively, for engaging an upwardly facing floor surface 1105 located outside the shower stall 1102.

A pair of crossbars 1144 underlie and support a pair of substantially horizontally extending seat members 1150, 1152, and connect with uprights 1164 for supporting a seat back member 1156 at a location above and behind the seat members 1150, 1152. The crossbars 1144, the seat members 1150, 1152, the uprights 1164 and the seat back 1156 are slidable, as a unit, along the length of the rails 1110, 1112 to provide a means for facilitating movement of an invalid or disabled person into and out of the shower stall 1102.

Referring to FIG. 12, bottom portions 1182 of a conventional, vertically-hung shower curtain 1180 are draped over the horizontal rails 1110, 1112 adjacent a location where the rails 1110, 1112 bridge a sill 1108 of the shower stall 1102. Because such bottom portions 1182 of the shower curtain 1180 as bridge between the rails 1110, 1112 are held aloft at a height that is greater than the height of the sill 1108, an "open space" that is designated generally by the numeral 1190 is defined beneath and between the rails 1110, 1112, through which water easily can splash on its way toward forming an undesirable puddle on a floor surface 1105 located outside the shower stall 1102.

The splash guard 1200 that is shown installed on the horizontal rails 1110, 1112 of the transfer bench 1100 cooperates with the lower portions 1182 of the shower curtain 1180 to effectively close the open space 1190 to prevent the unwanted splashing of water therethrough. Referring to FIGS. 11 and 13–15, the splash guard 1200 is defined by a pair of substantially identically configured, generally rectangular, slotted members 1210, 1212 (as exemplified by the member 1210 that is depicted in FIG. 13), and by a generally T-shaped slotted member 1314 (that is depicted in FIG. 14). All of the slotted members 1210, 1212, 1314 are substantially flat.

Because the generally rectangular splash guard members 1210, 1212 are of identical configuration, only the splash guard member 1210 will be described; and, in the drawings, the same numerals that are used in the description that follows to designate features of the splash guard member 1210 also are used to designate identical features of the identical splash guard member 1212.

Referring to FIG. 13, the splash guard member 1210 preferably is formed from a relatively rigid material such as high density polypropylene having a relatively uniform thickness of preferably about 0.08 inch (about 0.20 cm) except along exposed edge portions which preferably are rounded at a radius of curvature that equals about half of the substantially uniform thickness of the splash guard member 1210 (i.e., a radius of curvature of about 0.04 inch, or about 0.10 cm)—in the manner that exposed edge surfaces of the splash guard member 210 have been described as being smoothly rounded.

The splash guard member 1210 has top and bottom edge surfaces 1224, 1226, respectively, and left and right edge surfaces 1220, 1222, respectively. The distance that separates the top and bottom edge surfaces 1224, 1226 of the splash guard member 1210 is typically about twenty and a half inches (about 52.1 cm), and will be referred to as the "height" of the splash guard member 1210. The distance that separates the left and right edge surfaces 1220, 1222 is typically about eight and three quarter inches (about 22.2 cm), and will be referred to as the "width" of the splash guard member 1210. Because the top and bottom edge surfaces 1224, 1226 extend at right angles to the left and right edge surfaces 1220, 1222, the height and width of the splash guard member 1210 cooperate to impart a shape to the splash guard member 1210 that can be referred to as being "generally rectangular" in character.

An imaginary center axis, indicated in FIG. 13 by the numeral 1218, extends parallel to the left and right edge surfaces 1220, 1222 at a location that is mid-way between the left and right edge surfaces 1220, 1222. Rounded "corners" 1234, 1236 having a radius of curvature of preferably about one inch (about 2.5 cm) are defined at the junctures of the bottom edge surface 1226 with the left and right edge surfaces 1220, 1222, respectively. A rounded "corner" 1238 having a radius of curvature of preferably about one inch (about 2.5 cm) is defined at the juncture of the top edge surface 1224 with the right edge surface 1222. A finger-grip hole 1240 is defined by the member 1210 in the vicinity of the rounded "corner" 1238, with the hole 1240 preferably being of about one and one quarter inch (about 3.2 cm) in diameter.

Toward the upper left "corner" of the member 1210, an "inset" or "cut-out" 1250 is defined by an upwardly facing edge surface 1242 and a leftwardly facing edge surface 1244 that parallel the top edge surface 1224 and the left edge surface 1220, respectively. The surfaces 1242, 1244 are smoothly joined by a curved surface 1246 that preferably has a radius of curvature of about one inch (about 2.5 cm). Rounded "corners" 1248, 1249 that also preferably have a radius of curvature of about one inch (about 2.5 cm) form smooth junctures between the upwardly facing surface 1242 and the left edge surface 1220, and between the leftwardly facing surface 1244 and the top edge surface 1224, respectively.

Referring to FIG. 13, a U-shaped, substantially curvilinear slot 1270 is formed in the member 1210, with the curved slot 1270 opening through the upstanding right edge surface 1222. The curved slot 1270 is bordered by right/upper and left/lower edge surfaces 1272, 1274 that have radii of curvature that extend from a center point 1277. The radius of curvature of the right/upper surface 1272 is about three and three fourths inch (about 9.5 cm). The radius of curvature of the left/lower surface 1274 is about five inches (about 12.7 cm). By this arrangement, the curved surfaces 1272, 1274 define a width of the slot 1270 that is about one and one-fourth inches (about 3.2 cm).

Rounded "corners" 1271, 1273 are formed where the right/upper and left/lower edge surfaces 1272, 1274 join with the right edge surface 1222 as the curved slot 1270 opens through the right side of the member 1210. A semi-circular arc 1275 having a radius of curvature equal to half the width of the curved slot 1270 smoothly joins the left/upper and right/lower edge surfaces 1272, 1274. The arc 1275 is formed about a center point 1277 that is intersected by the center axis 1218.

Referring to FIG. 14, the splash guard member 1314 preferably is formed from a relatively rigid material such as high density polypropylene having a relatively uniform thickness of preferably about 0.08 inch (about 0.20 cm) except along exposed edge portions which preferably are rounded at a radius of curvature that equals about half of the substantially uniform thickness of the splash guard member 1314 (i.e., a radius of curvature of about 0.04 inch, or about 0.10 cm)—in the manner that exposed edge surfaces of the splash guard member 210 have been described as being smoothly rounded.

The splash guard member 1314 has top and bottom edge surfaces 1324, 1326, respectively, and left and right edge surfaces 1320, 1322, respectively. A centrally located formation 1325 projects upwardly from the top edge surface 1324, and has a finger grip hole 1340 formed therethrough. The distance that separates the uppermost part of the formation 1325 from the bottom edge surface 1326 defines the "height" of the splash guard member 1314, and typically is about twenty and a half inches (about 52.1 cm). The distance that separates the left and right edge surfaces 1320, 1322 is typically about twenty inches (about 50.8 cm), and will be referred to as the "width" of the splash guard member 1314.

The top edge surface 1324 and the left and right edge surfaces 1320, 1322 border the top and opposed ends of what will be referred to as a "crossbar" 1329 of a "T-shape" that characterizes the configuration of the splash guard member 1314. Depending projections 1325, 1327 are formed at the junctures of the left and right edge surfaces 1320, 1322 with bottom surface portions **1326*a*, 1326*b* of the crossbar 1329. The distance between the top edge surface 1324 and each of the bottom surface portions 1326*a*, 1326*b* is typically about two and seven-eights inches (about 7.3 cm), and defines the "width" of the crossbar 1329**.

The bottom surface portions **1326*a*, 1326*b* comprise what will be understood to be the "rail receiving formations" of the T-shaped splash guard member 1314. The T-shaped splash guard member 1314 is installed on the rails 1110, 1112 by positioning the member 1314 to "hang" with the surface portion 1326*a* extending atop and engaging the rail 1110, with the surface portion 1326*b* extending atop and engaging the rail 1112, and with a "stem" 1339 of the "T-shaped" member 1314 depending centrally from the crossbar 1329 and extending between the spaced rails 1110, 1112**.

The stem 1339 is a formation that depends centrally from the crossbar 1329, and is defined by opposed left and right edge surfaces **1320*a*, 1322*a*, and by the bottom edge surface 1326. The distance between the left and right edge surfaces 1320*a*, 1322*a* defines the "width" of the stem 1339**, and typically is about eight and three quarter inches (about 22.2 cm).

An imaginary center axis, indicated in FIG. 14 by the numeral 1318, extends parallel to the left and right edge surfaces 1320, 1322 at a location that is mid-way between the surfaces 1320, 1322. The center axis 1318 also parallels the left and right edge surfaces **1320*a*, 1322*a* at a location that is mid-way therebetween. By this arrangement, it will be seen that left and right "halves" of the splash guard member 1314 are symmetrical about the center axis 1318—whereby the "left half" of the member 1314 has a shape that is a mirror image of the "right half" of the member 1314**.

Rounded "corner" transition surfaces (they are not separately indicated by assigned numerals) preferably are formed at junctures of the above-described edge surfaces of the T-shaped splash guard member 1314. While the radii of curvature of such rounded corner formations are not, by any means, "critical," it will be understood from the descriptions of the rounded corner formations that are utilized in forming others of the described splash guard members that corner radii of about an inch ordinarily are employed in order to make a smooth, gentle transition between substantially perpendicular surfaces; that radii of curvature of less than an inch typically are used when the arc through which a transition curve is to turn is greater than ninety degrees; and that radii of curvature of greater than an inch tend to be most desirably utilized when the arc through which a transition curve is to turn is less than ninety degrees.

The splash guard 1200 illustrates a number of features of the present invention. One feature resides in the versatility of the invention in permitting a plural-piece splash guard to be defined by rail-hung members, some of which are "slotted" to define rail-receiving formations, and at least one of which does not need to be "slotted" to advantageously define rail-receiving formations (e.g., the T-shaped member 1314 and the rail receiving formations that are defined by the surface portions 1326*a*, 1326*b*).

Another feature illustrated by the embodiment 1200 resides in the provision of a splash guard that can accommodate a relatively wide range of transfer bench rail spacings without necessarily utilizing a splash guard component that carries even a single horizontally extending "linear slot." In the embodiment 1200, the relatively lengthy "arms" of the "crossbar" 1329 permit the rail-receiving surface portions 1326*a*, 1326*b* to be of sufficient length to accommodate a wide range of spacings of the rails 1110, 1112 of a transfer bench while capably serving to provide a meads for engaging the rails 1110, 1112 to support the member 1314 with its crossbar 1329 extending atop the rails 1110, 1112 In FIG. 15, the crossbar 1329 is shown extending atop relatively closely spaced rails 1110, 1112, while, in FIG. 16, the crossbar 1329 is shown extending atop relatively widely spaced rails 1110*a*, 1112*a*.

Figure 17:
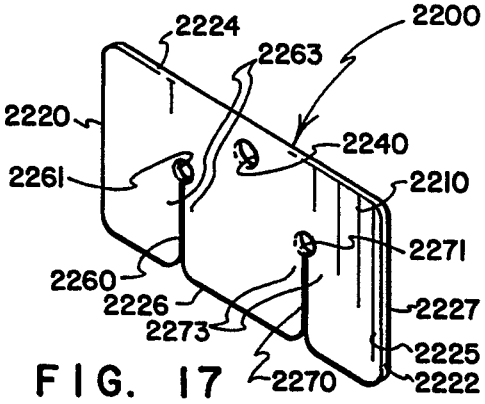
FIG. 17 is a perspective view showing still another form of splash guard member that can be used in a less preferred form of practice of the present invention.

Referring to FIG. 17, a less preferred splash guard embodiment is indicated generally by the numeral 2200. The embodiment 2200 employs a single, generally rectangular splash guard member 2210 that can be substituted for the set of splash guard members 210, 212 that have been described (in conjunction with FIGS. 1–9) for use with the rails 110, 112. To the extent that the splash guard member 2210 incorporates features that are identical to and/or functionally equivalent to features that have been described as being utilized by the splash guard member 210, corresponding reference numerals are used (they differ from those used with the member 210 by the addition of the number "2000" thereto) in FIG. 17.

The embodiment 2200 employs a single sheet 2210 of relatively stiff but nonetheless resiliently bendable material to define a substantially flat member that has a rapid-recovery memory that will return the material of the sheet 2210 to extend substantially within a common plane after portions of the sheet 2210 have been bent briefly out of the common plane. In the embodiment 2200, the rapid-recovery memory of the sheet 2210 is utilized to provide "openable" slot portions that return substantially automatically to a "normally closed" condition that serves in large measure to block the splashing of water through the openable slot portions. In particular, the sheet 2210 is provided with a pair of downwardly-opening elongate slots 2260, 2270 that extend substantially parallel to each other at a constant spacing that is selected to correspond to the precise on-center spacing of a pair of transfer bench rails (not shown in FIG. 17) with which the sheet 2210 is to be used.

The slots 2260, 2270 have enlarged upper end regions 2261, 2271, respectively, that define openings of sufficient size to permit transfer bench rails to pass freely therethrough. Extending along opposite sides of the slots 2260, 2270 at locations beneath the enlarged upper end regions 2261, 2271 are opposed side portions 2263, 2273 that normally extend substantially contiguously within the common plane of the sheet 2210, but which can be briefly bent out of the common plane of the sheet 2210 to permit the passage of transfer bench rails along the lengths of the slots 2260, 2270 to introduce such rails into and to remove such rails from the enlarged upper end regions 2261, 2271.

In the embodiment 2200, rapid-recovery memory characteristics of the sheet 2210 of material are relied upon to effect a prompt return of the opposed side portions 2263, 2273 of the slots 2260, 2270 to extend within the common plane of the sheet 2210 to effectively close and to maintain effective closure of the majority of the lengths of the slots 2260, 2270. For this purpose, the sheet 2210 preferably is formed from a relatively stiff but resiliently bendable material such as high density polypropylene having a relatively uniform thickness of preferably about 0.08 inch (about 0.20 cm) except along exposed edge portions which preferably are rounded at a radius of curvature that equals about half of the substantially uniform thickness of the sheet 2210 (i.e., a radius of curvature of about 0.04 inch, or about 0.10 cm) —in the manner that exposed edge surfaces of the splash guard member 210 have been described as being smoothly rounded.

Figure 18:
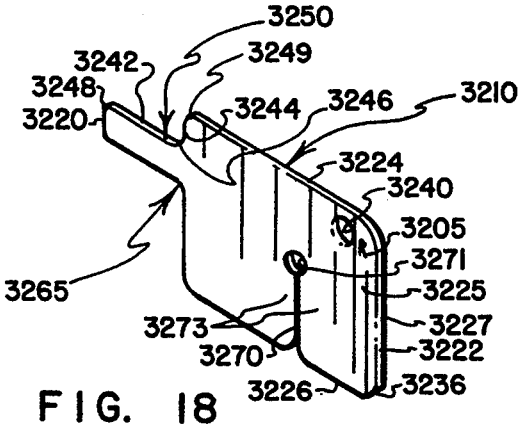
FIG. 18 is a perspective view showing still another form of splash guard member that can be used in a less preferred form of practice of the present invention.
Figure 19:
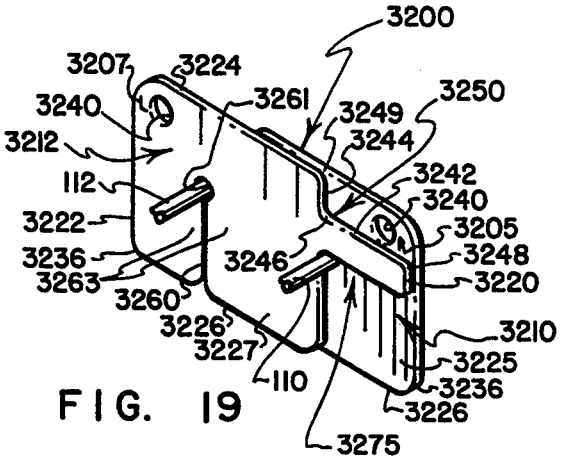
FIG. 19 is a perspective view showing a pair of the members that are depicted in FIG. 18 fully installed on portions of two relatively closely spaced, horizontally extending rails of a transfer bench; and, FIG. 20 is a perspective view similar to FIG. 19 but showing the members fully installed on portions of two relatively widely spaced, horizontally extending rails of a transfer bench.
Figure 20:
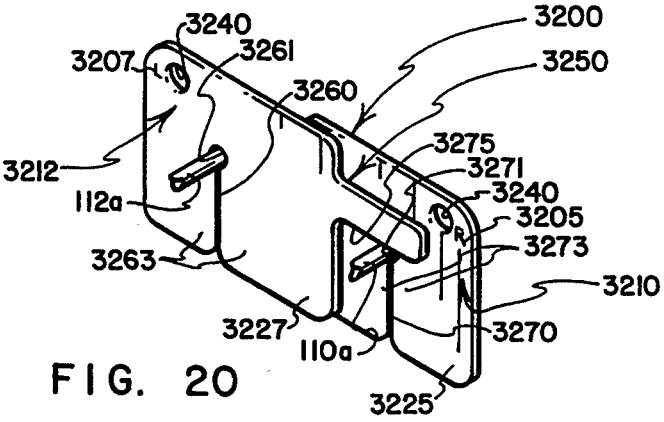

Referring to FIG. 19, still another less preferred splash guard embodiment is indicated generally by the numeral 3200. The embodiment 3200 employs a pair of substantially flat, identically configured splash guard members 3210, 3212 (see also FIG. 18 wherein only the splash guard member 3210 is depicted) that can be substituted for the set of splash guard members 210, 212 that have been described (in conjunction with FIGS. 1–9) for use with the rails 110, 112. The splash guard 3200 is depicted installed on relatively closely spaced rails 110, 112 in FIG. 19, and on relatively widely spaced rails 110*a*, 112*a* in FIG. 20.

Except for the provision of normally contiguously extending slot side portions 3263, 3273 (which are described shortly in greater detail) and the substitution of "cut out" regions 3265, 3275 (that define "rail receiving formations) taking the place of linear slots 260 (that define "rail receiving formations") that are utilized by the splash guard members 210, 212 to receive the rails 110, 112, the splash guard members 3210, 3212 are substantially identical in configuration to the above-described splash guard members 210, 212. To the extent that the splash guard members 3210, 3212 incorporate features that are identical to and/or that are functionally equivalent to features that have been described as being utilized by the splash guard members 210, 212, corresponding reference numerals are used (they differ from the reference numerals that are used with the members 210, 212 by the addition of the number "3000" thereto) to indicate corresponding features in FIGS. 18–20. Thus, for example, finger-grip holes 3240 are provided in the members 3210, 3212 that correspond to the finger-grip holes 240 that are provided in the members 210, 212; and, letters "R" and "L" (designated by reference numerals 3205, 3207, respectively) are imprinted on the members 3210, 3212 in the same fashion that the letters "R" and "L" (designated by reference numerals 205, 207, respectively) are described as being imprinted on the members 210, 212.

Like the previously described splash guard member 2210, the splash guard members 3210, 3212 each comprise a sheet of relatively stiff but nonetheless resiliently bendable material that inherently serves to maintain the members 3210, 3212 in a substantially flat configuration (i.e., with the material of each of the members 3210, 3212 extending within a separate "common plane"). The material from which the members 3210, 3212 are formed has a rapid-recovery memory that will return the material of the sheet to extend substantially within a common plane after portions of the sheet have been bent briefly out of the common plane. The rapid-recovery memory characteristic is utilized by the members 3210, 3212 to provide "openable" slot portions that return substantially automatically to a "normally closed" condition that serves in large measure to block the splashing of water through the openable slot portions.

In particular, the members 3210, 3212 define downwardly-opening elongate slots 3260, 3270 that each can receive a separate one of the rails 110, 112. The slots 3260, 3270 have enlarged upper end regions 3261, 3271, respectively, that define openings of sufficient size to permit one of the transfer bench rails 110, 112 to pass freely therethrough. Extending along opposite sides of the slots 3260, 3270 at locations beneath the enlarged upper end regions 3261, 3271 are opposed side portions 3263, 3273 that normally extend substantially contiguously within the common planes of the associated members 3210, 3212 but which can be briefly bent out of such common planes to permit the passage of one of a separate one of the transfer bench rails 110, 112 along the length of each of the slots 3260, 3270 to introduce the rails 110, 112 into and to remove the rails 110, 112 from the enlarged upper end regions 3261, 3271.

In the embodiment 3200, rapid-recovery memory characteristics of the sheets of material from which the members 3210, 3212 are formed are relied upon to effect a prompt return of the opposed side portions 3263, 3273 of the slots 3260, 3270 to extend within the common planes of their associated members 3210, 3212 to effectively close and to maintain effective closure of the majority of the lengths of the slots 3260, 3270. For this purpose, the members 3210, 3212 preferably each are formed from a relatively stiff but resiliently bendable sheet of material such as high density polypropylene having a relatively uniform thickness of preferably about 0.08 inch (about 0.20 cm) except along exposed edge portions which preferably are rounded at a radius of curvature that equals about half of the substantially uniform thickness of the sheet (i.e., a radius of curvature of about 0.04 inch, or about 0.10 cm)—in the manner that exposed edge surfaces of the splash guard member 210 have been described as being smoothly rounded.

Features that are illustrated by the embodiment 3200 include the use, in combination, of non-slotted rail-receiving formations and self-closing slots (namely the "cut out" regions 3265, 3275 in combination with the slots 3260, 3270 that have "self closing" side portions 3263, 3273) to provide a set of splash guard members that will (in substantially the same manner as the splash guard members 210, 212) accommodate a relatively wide range of transfer bench rail spacings; and the use of self-closing slots (that function in the manner of the self-closing slots 2260, 2270 of the splash guard member 2210) that do not need to be bridged by non-slotted material of a splash guard member in order to serve the function of substantially blocking the splashing of water therethrough.

As will be apparent from the foregoing, the present invention provides a nicely compact, simple to use method and means for cooperating with a draped shower curtain to block the splashing of water from inside a bath tub or shower stall onto floor areas located outside the bath tub or shower stall. In preferred practice, at least a pair of splash guard members are used in concert with non-slotted material of each serving to bridge and close open-slot area of the other, and with rail-receiving formations being provided that will accommodate a wide range of transfer bench rail spacings. In less preferred embodiments, so-called "self closing" slot portions make use of the rapid-recovery memory of resiliently bendable material that is used to form one or more splash guard members that can be installed on transfer bench rails for co-operating with draped shower curtains to block splash.

While such terms as "horizontally extending," "front," "rear," "forwardly facing," "rearwardly facing," "left," "right" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A splash guard for installation about a pair of spaced, substantially horizontally extending rails of a transfer bench for cooperating with a shower curtain that is draped over the rails to prevent water from splashing out of a shower stall or bath tub while the transfer bench is positioned to extend into and out of the stall or tub for supporting an invalid or disabled person, comprising:

a) flat member means for defining rail receiving formation means configured to enable the flat member means to be removably installed about the pair of spaced, substantially horizontally extending rails for cooperating with a shower curtain that is draped over the rails to prevent water from splashing out of a shower stall or bath tub while the transfer bench is positioned to extend into and out of the stall or tub;

b) wherein the flat member means includes at least one substantially flat member formed from water resistant material and being of a size and configuration that will permit the flat member means, when removably installed about the pair of spaced rails, to cooperate with a shower curtain that is draped over the rails to close at least a portion of an otherwise "open space" that is not closed by the draped shower curtain at a location between and beneath the rails, through which water otherwise can splash on its way toward forming an unwanted puddle on a floor surface outside the shower stall or bath tub;

c) wherein the rail receiving means includes slot means for extending from a perimeter surface of the at least one substantially flat member toward a central portion thereof for defining an elongate passage through which portions of at least one of the spaced rails can be installed and removed as the flat member means is installed about and removed from the spaced rails; and, d) passage closure means for effectively closing at least selected portions of the slot means for preventing water from splashing therethrough when the splash guard is installed about the rails for cooperating with the draped shower curtain.

2. The splash guard of claim 1 wherein the passage closure means is defined by forming said at least one substantially flat member from resiliently bendable material, with opposite sides of said selected portions of the slot means including portions of said resiliently bendable material means that normally extend substantially contiguously within a common plane so as to substantially close said selected portions of the slot means, with said portions of said resiliently bendable material means being temporarily resiliently bendable out of said common plane to open said selected portions of the slot means to passage therebetween of said portions of said at least one of the spaced rails during installation of the splash guard onto and removal of the splash guard from the spaced rails, and with the resiliently bendable material being selected to have a "memory" that will function to restore said portions of said resiliently bendable material to normally extend substantially contiguously within said common plane after said portions of said resiliently bendable material have been temporarily bent out of said common plane to permit passage therebetween of said portions of said at least one of the spaced rails.

3. The splash guard of claim 1 wherein:

a) the flat member means includes first and second substantially flat members that each are formed from water resistant material;

b) the slot means includes first slot means defined by the first flat member for extending from a perimeter surface of the first flat member toward a central portion thereof for defining a first elongate passage through which portions of a first of the two spaced rails can be installed and removed as the first flat member is installed about and removed from said first rail during installation of and removal from the spaced rails of the splash guard;

c) the slot means also includes second slot means defined by the second flat member for extending from a perimeter surface of the second flat member toward a central portion thereof for defining a second elongate passage through which portions of a second of the two spaced rails can be installed and removed as the second flat member is installed about and removed from said second rail during installation of and removal from the spaced rails of the splash guard; and, d) the passage closure means includes portions of at least a selected one of the first and second flat members that are configured to overlie and bridge between at least selected portions of the slot means that is defined by the other of the first and second flat members for preventing water from splashing therethrough when the splash guard is installed about the rails for cooperating with the draped shower curtain.

4. The splash guard of claim 1 wherein said one flat member is of sufficient size to permit its concurrently extending about each of said rails when the splash guard is installed on the rails, and said slot means includes a) first slot means for extending from a first portion of the perimeter surface of said one flat member toward a first central portion thereof for defining a first elongate passage through which portions of a first of the two spaced rails can be installed and removed as said one flat member is installed about and removed from the spaced rails, and b) second slot means for extending from a second portion of the perimeter surface of said one flat member toward a second central portion thereof for defining a second elongate passage through which portions of a second of the two spaced rails can be installed and removed as said one flat member is installed about and removed from the spaced rails.

5. The splash guard of claim 1 wherein said flat member means includes first and second substantially flat members that each is of sufficient size to permit its concurrently extending about each of said rails when the splash guard is installed on the rails, and said slot means includes:

a) first slot means for extending from a first portion of the perimeter surface of said first flat member toward a first central portion thereof for defining a first elongate passage through which portions of a first of the two spaced rails can be installed and removed as said first flat member is installed about and removed from the spaced rails;

b) second slot means for extending from a second portion of the perimeter surface of said first flat member toward a second central portion thereof for defining a second elongate passage through which portions of a second of the two spaced rails can be installed and removed as said first flat member is installed about and removed from the spaced rails;

c) third slot means for extending from a third portion of the perimeter surface of said second flat member toward a third central portion thereof for defining a third elongate passage through which portions of a second of the two spaced rails can be installed and removed as said second flat member is installed about and removed from the spaced rails; and, d) fourth slot means for extending from a fourth portion of the perimeter surface of said second flat member toward a fourth central portion thereof for defining a fourth elongate passage through which portions of a second of the two spaced rails can be installed and removed as said second flat member is installed about and removed from the spaced rails.

6. The splash guard of claim 5 wherein the passage closure means includes portions of at least a selected one of said first and second flat members that are configured to overlie and bridge between at least selected portions of such slot means as is defined by the other of the first and second flat members for preventing water from splashing therethrough when the splash guard is installed about the rails for cooperating with the draped shower curtain.

7. The splash guard of claim 1, 2, 3 or 4 wherein the material from which said one flat member is formed comprises a body of material that normally extends substantially within a common plane and that is configured such that its center of gravity is located beneath loci of supporting engagement of said one flat member with the rails when the splash guard is installed on the rails, whereby the force of gravity acting on said body tends to orient said body to extend within a substantially vertical plane that includes said loci and said center of gravity when the splash guard is installed on the rails.

8. A splash guard for installation about a pair of spaced, substantially horizontally extending rails of a transfer bench for cooperating with a shower curtain that is draped over the rails to prevent water from splashing out of a shower stall or bath tub while the transfer bench is positioned to extend into and out of the stall or tub for supporting an invalid or disabled person, comprising:

a) a first member defined by a first body of relatively flat material that is perimetrically bounded by a first edge;

b) first rail engaging formation means including a spaced pair of first rail engaging formations that are defined by the first edge and are configured to be brought into concurrent engagement with the pair of horizontally extending rails of the transfer bench for supporting the first member as by hanging the first member from the pair of rails so that the first body of relatively flat material extends in a substantially vertical first plane with portions of the first body extending about the pair of rails for overlying and cooperating with portions of a shower curtain that is draped over the pair of rails;

c) a second member defined by a second body of relatively flat material that is perimetrically bounded by a second edge; and, d) second rail engaging formation means including at least one second rail engaging formation that is defined by the second edge and that is configured to engage at least a selected one of the pair of rails for at least partially supporting the second member as by hanging the second member from said selected one of the rails so that the second body of relatively flat material extends in a substantially vertical second plane that substantially parallels the first plane with portions of the second body extending about said selected one of the rails so as to complement said portions of the first body in cooperating with portions of the shower curtain that is draped over the pair of rails to function as a splash guard to prevent water from splashing past such portions of the first plane as are occupied by the first body, and such portions of the second plane as are occupied by the second body.

9. The splash guard of claim 8 wherein the first rail engaging formation means is configured such that, when the first rail engaging formation concurrently engages the pair of rails, the center of gravity of the first body is positioned at a height that is below the height of each of such rail portions as are engaged by the first member when the first member is hung from the pair of rails, whereby the force of gravity acting on the first member is caused to assist in orienting the first body to extend within a vertical plane.

10. The splash guard of claim 8 wherein the second rail engaging formation means includes a spaced pair of second rail engaging formations that are defined by the second edge and are configured to be brought into concurrent engagement with the pair of horizontally extending rails of the transfer bench for supporting the second member as by hanging the second member from the pair of rails so that the second body of relatively flat material extends in said second plane with portions of the second body extending about the pair of rails for overlying and cooperating with portions of the first member and with portions of the shower curtain that is draped over the pair of rails to prevent water from splashing past such portions of the first plane as are occupied by the first body and such portions of the second plane as are occupied by the second body.

11. The splash guard of claim 10 wherein the second rail engaging formation means is configured such that, when the second rail engaging formation concurrently engages the pair of rails, the center of gravity of the second body is positioned at a height that is below the height of each of such rail portions as are engaged by the second member when the second member is hung from the pair of rails, whereby the force of gravity acting on the second member is caused to assist in orienting the second body to extend within a vertical plane.

12. The splash guard of claim 3, 5, 6, 8 or 10 wherein the first and second members extend non-congruently when installed about the spaced rails for cooperating with the draped shower curtain.

13. The splash guard of claim 3, 5, 6, 8 or 10 wherein:

a) the first and second members are configured to extend non-congruently when installed about the spaced rails for cooperating with the draped shower curtain, whereby at least a selected one of the first and second members defines a portion that extends about the spaced rails at a location to which the other of the first and second members does not extend; and, b) finger grip formation means is defined by said selected one of the first and second members at said location for enabling said selected one of the first and second members to be gripped by one's fingers to be moved relative to the other of the first and second members for installation about and removal of the selected one of the first and second members from the spaced rails.

14. The splash guard of claims 3, 5, 6, 8 or 10 wherein:

a) the first and second members are configured to extend non-congruently when installed about spaced rails that are spaced apart within a predetermined range of rail spacings, with the first and second members being configured to extend non-congruently side-by-side when so installed;

b) the first member being configured to define finger grip formation means for providing a finger-engageable formation that can be securely gripped by one's fingers; and, c) the second member being configured to define a peripheral shape, no portion of which extend side-by-side with the finger-engageable formation when the first and second members are installed about spaced rails so long as the spacings of the rails on which the first and second members are installed falls within said range.

15. The splash guard of claims 3, 5, 6, 8 or 10 wherein:

a) each of the first and second member is formed from a relatively thin sheet of material that has a front surface and an opposed, substantially parallel-extending rear surface;

b) the first and second members are configured to be installed on the rails of the transfer bench in side-by-side, overlapping relationship, with the rear surfaces of the first and second members have portions thereof that face toward each other and extend non-congruently side-by-side;

c) a letter "L" is imprinted on such portions of the rear surfaces of each of the first and second members as are remain visible when the first and second members are installed on the rails of the transfer bench; and, d) a letter "R" is imprinted on the front surface portions of each of the first and second members that also remain visible when the first and second members are installed on the rails of the transfer bench.

16. The splash guard of claim 1, 2, 3, 4, 5, 6 8 or 10 wherein said at least one member has a perimeter surface that defines a generally rectangular shape.

17. The splash guard of claim 1, 2, 3, 4, 5, 6 or 7 wherein said at least one member includes finger grip formation means defined at a location along its perimeter for enabling said at least one member to be gripped by one's fingers to be moved relative to the rails during installation about and removal from the spaced rails.

18. The splash guard of claim 1, 2, 3, 4, 5 or 6 wherein said slot means includes at least one substantially linear slot that extends from a perimeter surface of the at least one member toward a central portion thereof for defining a substantially linear elongate passage through which portions of at least one of the spaced rails can be installed and removed as the flat member means is installed about and removed from the spaced rails.

19. The splash guard of claim 1, 2, 3, 4, 5 or 6 wherein said slot means includes at least one substantially curvilinear slot that extends from a perimeter surface of the at least one member toward a central portion thereof for defining a substantially curvilinear elongate passage through which portions of at least one of the spaced rails can be installed and removed as the flat member means is installed about and removed from the spaced rails.

20. The splash guard of claim 1, 2, 3, 4, 5 or 6 wherein said slot means includes:

a) at least one substantially linear slot that extends from a perimeter surface of the at least one member toward a first central portion thereof for defining a substantially linear elongate passage through which portions of a selected one of the spaced rails can be installed and removed as said one flat member is installed about and removed from the spaced rails; and, b) at least one substantially curvilinear slot that extends from said perimeter surface of said one member toward a second central portion thereof for defining a substantially curvilinear elongate passage through which portions of the other of the spaced rails can be installed and removed as said one flat member is installed about and removed from the spaced rails.

21. The splash guard of claim 1, 2, 3, 4, 5 or 6 wherein said slot means is configured to permit the splash guard to be installed about pairs of spaced rails of transfer benches wherein the distances by which the rails of each pair are spaced differ within a predetermined range of distances.

22. The splash guard of claim 1, 2, 3, 4, 5 or 6 wherein said slot means is configured to permit the splash guard to be installed about pairs of spaced rails of transfer benches wherein the distances by which the rails of each pair are spaced differ within a predetermined range of distances of about ten inches on center to about seventeen inches on center.

23. The splash guard of claim 1, 2, 3, 4, 5, 6, 8, 9, 10 or 11 in combination with a transfer bench that defines a pair of horizontally extending seat-supporting rails on which the splash guard may be removably installed.

* * * * *